United States Patent [19]

Alber

[11] 4,162,089

[45] Jul. 24, 1979

[54] SKI BINDING

[76] Inventor: Franz Alber, Nordwestbahnstr. 15/10, Vienna, Austria, A 1020

[21] Appl. No.: 838,894

[22] Filed: Oct. 3, 1977

[30] Foreign Application Priority Data

Oct. 4, 1976 [AT] Austria ..... 107360/76

[51] Int. Cl.[2] ..... A63C 9/00

[52] U.S. Cl. ..... 280/618; 36/117; 280/11.36; 280/611

[58] Field of Search ..... 280/618, 611, 636, 11.36; 36/89, 118, 121, 117

[56] References Cited

U.S. PATENT DOCUMENTS

| | | | |
|---|---|---|---|
| 3,538,627 | 11/1970 | Labat-Camy | 280/611 |
| 3,609,887 | 10/1971 | Hickmann et al. | 36/121 |
| 3,775,866 | 12/1973 | Marker | 36/117 |
| 3,812,602 | 5/1974 | Gertsch et al. | 280/618 |
| 3,854,743 | 12/1974 | Hansen | 36/121 |

FOREIGN PATENT DOCUMENTS

| | | | |
|---|---|---|---|
| 1816811 | 6/1970 | Fed. Rep. of Germany | 36/117 |
| 2017310 | 2/1971 | Fed. Rep. of Germany | 36/117 |
| 2049450 | 5/1971 | Fed. Rep. of Germany | 280/618 |
| 2340622 | 4/1974 | Fed. Rep. of Germany | 36/121 |
| 457235 | 7/1968 | Switzerland | 280/618 |

*Primary Examiner*—David M. Mitchell
*Attorney, Agent, or Firm*—Fleit & Jacobson

[57] ABSTRACT

A combined ski boot and ski binding. The ski boot has a lower portion made of pliant material integral with an upper portion made of rigid material. The ski binding has a sole plate that is releasably connected to the top surface of a ski with side edges of the sole plate extending generally parallel to the longitudinal axis of the ski. Fastening members are hingedly connected to the side edges of the sole plates. A cooperating fastening mechanism releasably interconnects the fastening members with the upper portion of the ski boot.

9 Claims, 11 Drawing Figures

FIG. 9
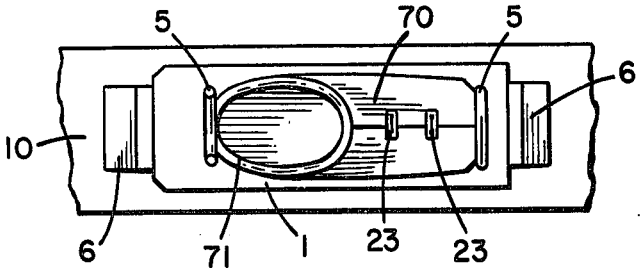
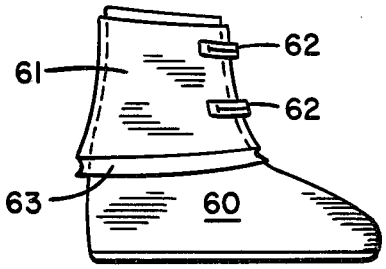
FIG. 7
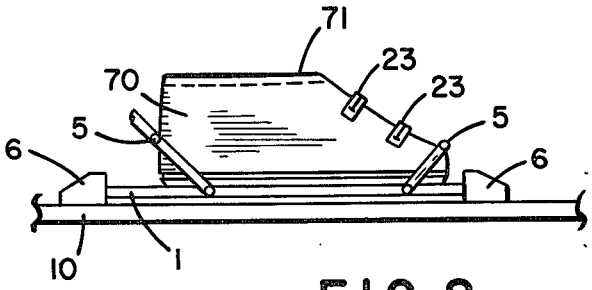
FIG. 8
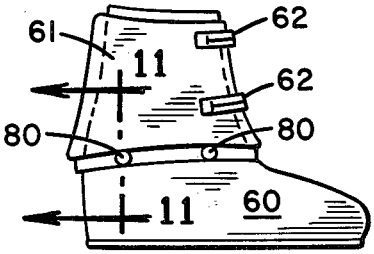
FIG. 10
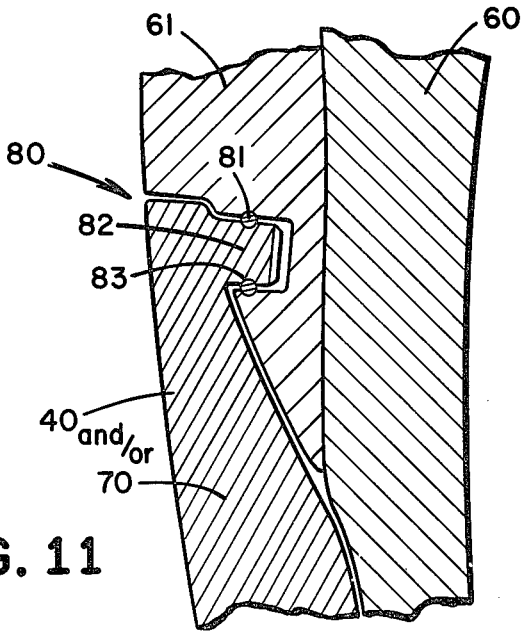
FIG. 11

SKI BINDING

BACKGROUND OF THE INVENTION

1. Field of the Invention

The invention is concerned with a ski-binding, with a sole plate that is fastened to the ski by means of an, at least involuntarily, detachable safety locking device and on which, within the region of their two lateral edges, fastening members are pivoted. The fastening members having axes of rotation which run parallel to the longitudinal direction of the plate, and which are held together within the region of the arch of the foot, in the downhill-run position, by means of buckles or of similar devices, while the regions of toes and heels are left free by the fastening members.

The ski-shoe that appertains to the above, known ski-binding is a soft shoe which is held by means of the fastening members within the area extending from the fore-foot to the ankle region..

2. Description of the Prior Art

Modern skiing technique is, as a matter of fact, based on the awareness of the fact that the control movements of the ski must originate in the lower leg and reach the ski from there. p Accordingly, it has already been proposed that, by way of a further development of a ski binding of that type, e.g. additional fastening members be attached to the fastening members, in such a way that they may be rotated, and that they enclose the foot upward, beyond the ankle and into the region of the lower leg. But, in that case, there exists the disadvantage that only a very imperfectly form-locking enclosure of the foot which wears a soft inner shoe, is possible by means of said additional fastening members; there remains also a certain undesirable amount of mobility within the region of an ankle. Beyond that fact, the operating efficiency of the binding is snow and ice is not ensured at all times, due to the presence of the swiveling connections. Similar considerations apply to those attempts at solving the problem that provide stiffening members on the sole plate that hold the leg solely within the region of the fore-leg but not, at the same time, also within the region of the fore-foot.

For that reason, so-called "shell-shoes" ("Schalenschuhe") have been preferred up to this time; said shell-shoes have a rigid outer shell extending above the ankle by which shell the fore-foot is fixed more or less rigidly on the lower leg. That agrees, it is true, with the requirements of modern skiing technique, but it is practically impossible to walk with these shoes normally. That is the point where the present invention is brought into play, it has posed, as its problem, the creation of a ski-shoe that is coordinated with the ski-binding mentioned at the outset, and which makes it possible, on the one hand, to walk normally, but on the other hand, to ski in accordance with the aforementioned modern skiing technique.

SUMMARY OF THE INVENTION

In accordance with the invention, that problem is solved by having the co-ordinated shoe present, within the region of the leg of the shoe, a sleeve that is co-ordinated, at least, with the lower leg, said sleeve being made of a harder material than the uppers of the shoe which are located below said sleeve and are coordinated with the fastening members, and which in the downhill-run position can be interlocked with the upper edge of the two fastening members, while the contours of the lateral edges of the fastening members are co-ordinated with the lower edge of the sleeve and fix the sleeve in the downhill-run position.

In that way, the use of considerably simpler and less complicated ski-shoes is ensured, with which it is possible readily to walk without any difficulty while, at the same time, a support of the foot that is rigid in its relation to the binding mechanism—particularly within the region of the lower leg—is ensured.

Interlocking between the fastening members on the one hand, and the sleeve on the other hand may be achieved, in accordance with the invention, e.g. by means of a groove and tongue.

The soft inner shoe is firmly connected with the sleeve and, otherwise, designed in such a way that it makes it possible for the wearer readily to walk without any difficulty while the ski is in transport, the fastening members and/or the uppers of the shoes may remain on the sole-plate of the ski and the sole-plate may remain on the ski. That means a very considerable simplification as to the handling and shipping of the shoes.

By way of a further development of the invention, the arrangement has been made in such a way that the width of the fastening members is about the same as that of the sole-plate, while one fastening member is wider than the other, so that, in the transport position both fastening members may be swung toward the upper side of the plate.

It is true that the division of the outer boot-shank into a sleeve and an upper-part is known as such, but only in ski-shoes the co-ordinated skibinding of which is of a type different from the one named at the outset. In addition, the ski-shoes themselves are of a different type, inasmuch as the sleeve is purely an ankle cuff, but not a lower leg sleeve.

BRIEF DESCRIPTION OF THE DRAWINGS

In the following, the invention will be explained on the basis of the drawings, by way of examples:

FIG. 7 shows a ski-shoe for the binding in accordance with FIG. 2, FIG. 8 shows a further possible form of an embodiment of the ski-binding in accordance with the invention as seen from the side; in this embodiment, the fastening members have the form of a shoe, FIG. 9 shows a top-view, FIG. 10 shows still another form of the embodiment of the invention of a ski-shoe, and FIG. 11 shows a section along the line Xl—Xl of FIG. 10.

DESCRIPTION OF THE PREFERRED EMBODIMENTS

Figure 1:
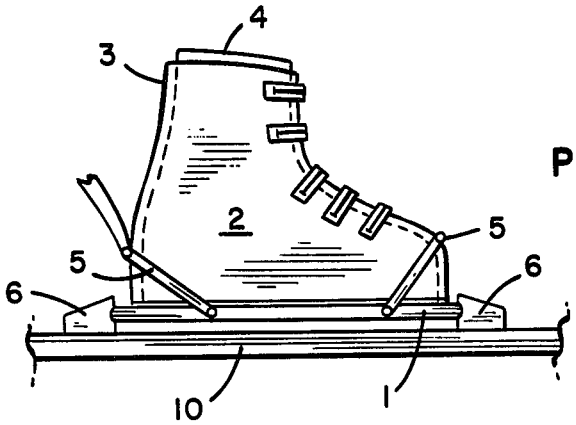
FIG. 1 PRIOR ART
FIG. 1 of the drawings shows schematically a ski-shoe with completely rigid outer shell, placed in a known plate-binding.
Figure 4:
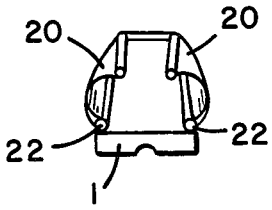
FIG. 4 shows the binding in accordance with FIG. 2 as seen in perspective.

In accordance with FIG. 1, the receptacle for the ski-shoe is constituted by a plate 1 on which the shoe 2 has been placed. The shoe 2 consists of a hard shell (outer shoe) 3 having a stable form, and of an inner shoe made of pliable material. The fastening members 5 which are known as such, have been designated by 5; they make it possible for the shoe to attach itself firmly to the plate 1. The binding members for the detachable fixation of plate 1 on ski 10 have been designated by 6.

Figure 2:
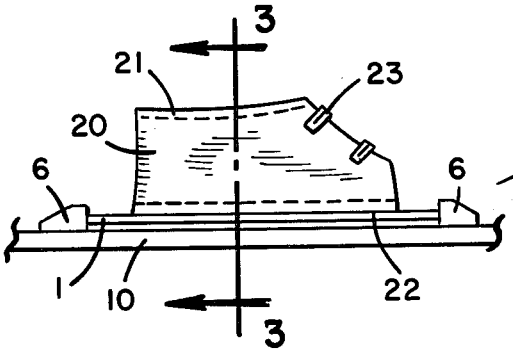
FIG. 2 shows a binding in accordance with the invention as viewed laterally.
Figure 5:
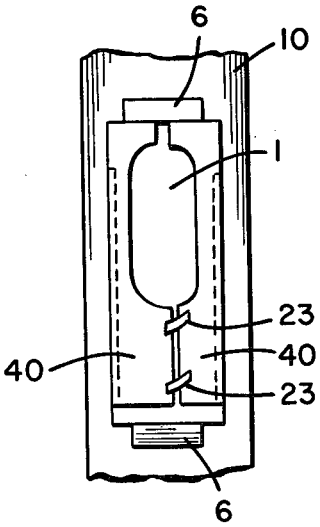
FIG. 5 shows a top-view of the binding in accordance with FIG. 2.

In accordance with the embodiment of the design in accordance with the invention, as shown in FIG. 2, the holding members are constituted by two shell parts 20. But, the invention is not restricted to that number of shell parts. Said shell parts are hinged to the plate 1, on both sides of said plate, approximately in the longitudinal direction of the ski. The pertinent hinge-joint has been designated by 22. But, the invention is not restricted to the use of a plate; thus, e.g. a frame construction, an arrangement of bars, or any similar device may be used. Said shell parts consist of hard material of stable form, e.g. such material as is used for the conventional shell-shoes, such as materials made of polyurethanes. Said shell-parts extend, approximately, just below the ankle, form supports for the middle-foot and, advantageously, overlap the fore-foot. The flaps overlapping the fore-foot have been designated by 40 in FIG. 5. The mutual fixation and/or locking of the shell parts preferably takes place by the tightening and/or clamping closures 23 which are known as closures of ski-shoes; accordingly, the flaps 40 may either overlap or end at a distance from one another.

In addition, the shell parts of the binding have been designed in such a way that the region of the toes and/or of the heel is left free. The advantage arising therefrom consists in the fact that, thereby, the binding is not limited to a certain shoe size. The shell parts 10 form one unit with the sole plate 1, and said unit may be considered part of an outer shoe.

Said unit may be complemented by having the inside of those shell parts imitate the form of the foot or the form of an inner shoe, or by adapting them to said forms. That may be done, e.g., individually by means of foaming, in a way that is, as such, known in connection with the fitting of the shell shoes known up to this time, to the form of the foot of the skier.

In accordance with another form of embodiment of the invention, the holding organs are constituted by a shoe made of hard material of a stable form, and which extends, at least, above the instep. In this case, the shoe is closed all around but it is possible also that—as in the example of the embodiment of the invention in accordance with FIG. 2—the areas covering the point of the foot and the heel are absent. FIGS. 7 and 8 show a shoe 70 of that type that is closed all around, and which has been firmly attached to the plate 1 by means of the conventional fastening organs 5 (see also FIG. 1). By way of a modification, this shoe may also be connected rigidly with the plate. The parts that are identical with the binding in accordance with FIG. 2 have been designated by the same reference numbers in FIGS. 8 and 9.

On the basis of the binding in accordance with the invention, it is not necessary any longer to design the ski-shoe with a continuously hard outer shell as has been the case up this time. Rather, it is possible to restrict said hard outer shell to the leg part which extends advantageously over the ankle, and to join that leg part with the shell parts of the binding in a form-locking way.

Either one of FIGS. 7 and 10 shows a ski-shoe of that type; said ski-shoe in accordance with the invention differs solely as to the particular type of the form-locking connection. In accordance with those FIGS., a stiff outer shoe cuff has been joined to an inner shoe 60. The clamping buckles have been designated by 62. A groove-and-tongue joint may be provided as form-locking connection; it is designed in such a way that the tongue may be placed and removed from the groove, while being deformed elastically.

A design of the form-locking connection of that type may be found also in the examples of the embodiment of the invention in accordance with FIGS. 2 and/or 7 and FIGS. 8 and/or 9 where the tongue mounted on the insides of the shell parts has been designated by 21 and 71, respectively, and the groove formed on the shoe has been designated by 63. Instead of the groove-and-tongue connection, a zipper closure or a velcro-closure may be provided.

It has been found that satisfactory results in regard to the form-locking connection can be achieved also when, at least, two connections have been provided that have been designed in the form of snap fasteners, snap-bolt connections, or similar devices. Preferably, 4 connections of that type are provided. FIG. 10 shows a ski-shoe designed in that way; in it, said connections have been designated by 80, and parts that have been designed appropriately and are located on the shell parts (not shown) or on a shoe-like holding organ, correspond to said connections 80.

In addition to the locked form achieved by the aforementioned connections, profile parts along the area of the connections may also be provided.

FIG. 11 shows a cross-section along the line XI—XI of FIG. 10, when the connection 80 has been designed as a snap-bolt connection. A buckle and/or ring 81 is held elastically in the outer-shoe part 61. The shell part 40 and/or the shoe-shaped fastening organ 70 have been designed with a block-like extension 82 which has a groove 83 for receiving the buckle and/or ring 81. Advantageously, the arrangement of the locking parts as described on the shell parts and on the leg of the outer shoe and/or on the binding-shoe and outer shoe-leg takes place in such a way that the ankle portion of the foot is held forcibly in a downhill-run position which is slightly inclined toward the front.

Figure 3:
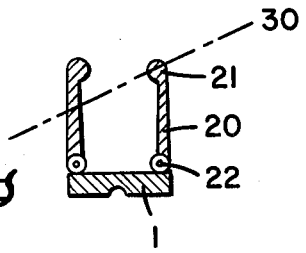
FIG. 3 shows a section along the line III—III of FIG. 2, but without the ski.
Figure 6:
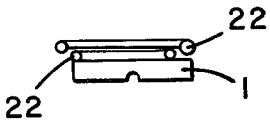
FIG. 6 shows the same view as FIG. 3 but with the parts of the shell folded onto one another.

The upper limiting edges of the shell-parts 40 of the binding and/or of the binding shoe 70 may lie—as required by anatomical considerations—advantageously in a plane that is transversely inclined in relation to the plate of the ski-binding. That plane of division has been suggested by dotted lines in FIG. 3 and has been designated by 30. The inclined plane of division 30 is of interest, particularly in the case of the example of the embodiment of the design in accordance with FIG. 2, because in this case, the arrangement may be made more easily, in such a way that, for the movement of the holding organs into a transport position, the holding organs may be folded to such an extent as to form a plane that is more or less parallel to the binding plate, as is shown schematically in FIG. 6. For instance, as illustrated in FIG. 6, the left-hand hinge joint 22 is positioned close to the top surface of plate 1, while the right-hand hinge joint 22 is spaced from the top surface of plate 1 by a distance equal to or greater than the collapsed height of the left-hand hinge joint. Further, the erected height of the left-hand hinge joint is less than the distance between the two hinge joints so that the left-hand hinge joint can be folded onto the top surface of plate 1 without contacting the base of the right-hand hinge joint. The right-hand joint can then be folded on top of the left-hand hinge joint.

The fixing of the shoe, and therefore of the foot of the skier on the sole-plate has been rendered rigid by the binding as described above, to such an extent that correct skiing is possible. But, the advantage consists now in the fact that in the case of said bindings, the conventionally used shell-shoes are not required any longer, but that instead of them, a ski-shoe is used, for which it is sufficient that the leg part is rigid while the anterior part of the shoe may be made of pliant material and the ski-shoe may, then, be limited more or less to the inner shoe. In any case, it is now possible to walk with a shoe shaped in that way, without any difficulty; a more or less free mobility has been ensured, The hard shell part of the shoe is limited to the leg part which is joined to the inner shoe, divided longitudinally for putting on the shoe, and provided with—possibly adjustable—clamps or similar devices, so as to achieve firm fit and fixation.

I claim:

1. A combined ski boot and ski binding comprising:

(a) a ski boot having a lower portion made of pliant material integral with an upper portion made of rigid material;

(b) a ski binding having:

(1) a sole plate adapted to be releasably connected to the top surface of a ski with side edges of the sole plate extending generally parallel to the longitudinal axis of the ski;

(2) fastening members hingedly connected to the side edges of the sole plate; and (c) cooperating fastening means for releasably interconnecting said fastening members and said upper portion of said ski boot, said cooperating fastening means having a first component associated with said fastening members and a second component associated with said upper portion of said ski boot.

2. The combination claimed in claim 1 wherein one of said components of said cooperating fastening means is a groove formed in one of said interconnected fastening members and upper portion, and wherein the other of said components of said cooperating fastening means is a tongue engageable with said groove, said tongue being formed in the other of said interconnected fastening members and upper portion.

3. The combination claimed in claim 1 wherein said fastening members are foldable towards each other, wherein the height of one of said fastening members is less than the distance between said fastening members so that said one fastening member is foldable onto the top surface of said sole plate, and wherein the other of said fastening members is hingedly connected to the side edge of the sole plate in such manner that the other of said fastening members is foldable on top of said one fastening member folded onto the top surface of the sole plate.

4. The combination claimed in claim 1 wherein said fastening members when interconnected with said upper portion of said ski boot are free from contact with front portions of said lower portion of said ski boot.

5. The combination claimed in claim 1 wherein said fastening members when interconnected with said upper portion of said ski boot have surfaces contacting said lower portion of said ski boot, said contacting surfaces having a shape mating with the shape of said lower portion.

6. The combination claimed in claim 1 wherein said cooperating fastening means interconnects said fastening members and said upper portion in such manner that the ankle portion of the foot of a user of said ski boot is held at an angle inclined to a plane normal to the top surface of the ski.

7. The combination claimed in claim 1 wherein said fastening members include means for interconnecting said fastening members to each other when said fastening members are interconnected with said upper portion of said ski boot.

8. The combination recited in claim 1 wherein said fastening members when interconnected with said upper portion of said ski boot have overlapping edges above a forward portion of the ski boot.

9. The combination recited in claim 1 wherein said fastening members when interconnected with said upper portion of said ski boot have edges spaced from each other above a forward portion of the ski boot.

* * * * *